United States Patent [19]

Burns

[11] Patent Number: 4,606,838

[45] Date of Patent: Aug. 19, 1986

[54] BLEACHING COMPOSITIONS COMPRISING ALKOXY SUBSTITUTED AROMATIC PEROXYACIDS

[75] Inventor: Michael E. Burns, West Chester, Ohio

[73] Assignee: The Procter & Gamble Company, Cincinnati, Ohio

[21] Appl. No.: 781,387

[22] Filed: Sep. 27, 1985

Related U.S. Application Data

[62] Division of Ser. No. 711,901, Mar. 14, 1985.

[51] Int. Cl.[4] ..... C11D 7/54

[52] U.S. Cl. ..... 252/94; 252/95; 252/99; 252/135; 252/186.1; 560/73

[58] Field of Search ..... 252/94, 95, 186.1, 135, 252/99; 560/73

[56] References Cited

U.S. PATENT DOCUMENTS

| | | | |
|---|---|---|---|
| 3,130,165 | 4/1964 | Brocklehurst | 252/99 |
| 3,686,127 | 8/1972 | Boldingh | 252/99 |
| 4,154,695 | 5/1979 | McCrudden | 252/99 |
| 4,283,301 | 8/1981 | Diehl | 252/102 |
| 4,287,135 | 9/1981 | Stoker | 252/186.1 |
| 4,288,388 | 9/1981 | McCrudden | 260/502 R |
| 4,412,934 | 11/1983 | Chung | 252/186.38 |
| 4,483,781 | 11/1984 | Hartman | 252/174.12 |
| 4,536,314 | 8/1985 | Hardy et al. | 252/102 |
| 4,539,130 | 9/1985 | Thompson et al. | 252/94 |

*Primary Examiner*—Paul Lieberman
*Assistant Examiner*—Hoa Van Le
*Attorney, Agent, or Firm*—Darla P. Neaveill; Richard C. Witte; Thomas H. O'Flaherty

[57] ABSTRACT

This invention relates to bleaching compounds and compositions that provide effective and efficient surface bleaching of textiles over a wide range of bleach solution temperatures. The compounds of the invention are a $C_4$–$C_8$ alkoxy substituted aromatic bleach activator. In a preferred embodiment, the bleaching compositions of the invention are detergent compositions.

24 Claims, No Drawings

BLEACHING COMPOSITIONS COMPRISING ALKOXY SUBSTITUTED AROMATIC PEROXYACIDS

This is a division of application Ser. No. 711,901, filed on Mar. 14, 1985.

BACKGROUND OF THE INVENTION

Technical Field

This invention relates to peroxygen bleaching compositions and processes therefor that provide effective surface bleaching of textiles over a wide range of temperatures. Surface bleaching of textiles is bleaching wherein the bleaching mechanism takes place on the textile surface, and, thereby, removes stains and/or soils.

SUMMARY OF THE INVENTION

The present invention relates to a bleaching compound providing a peroxyacid of the following general formula

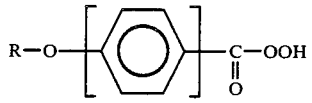

wherein R is an alkyl group containing from about 4 to about 8 carbon atoms. The benzene ring may be additionally substituted with for example, an alkyl group or a chloro or nitro group.

Preferred compounds which provide the above peroxyacid are the magnesium salts of the peroxyacid of the following general formula

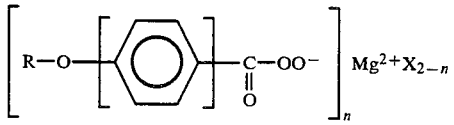

wherein R is as defined for the peroxyacid, X is a compatible anion, and n is 1 or 2.

The peroxyacids may be formed in situ from the corresponding diacyl peroxides. The peroxyacids may also be formed in situ from a peroxygen bleaching compound capable of yielding hydrogen peroxide in aqueous solution and a bleach activator of the following formula

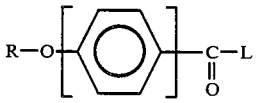

wherein R is as defined for the peroxy acid, and L is a leaving group, the conjugate acid of which has a pKa of from about 4 to about 13.

The invention also relates to bleaching compositions which contain one of the above compounds. Where the composition contains the bleach activator, another essential component is a peroxygen bleaching compound capable of yielding hydrogen peroxide in aqueous solution. In a preferred embodiment, the bleaching compositions are incorporated into detergent compositions.

DETAILED DESCRIPTION OF THE INVENTION

The invention relates to bleaching compounds which provide alkoxy substituted aromatic peroxyacids of the following general formula:

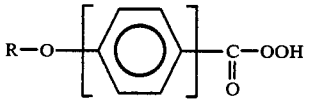

wherein R is an alkyl group with from about 4 to about 8 carbon atoms, preferably about 5 to about 8 carbon atoms, and most preferably about 6 carbon atoms. The benzene ring may be optionally substituted further as with, e.g., an alkyl group, a chloro or nitro group.

The bleaching compounds of the invention provide effective and efficient surface bleaching of textiles which thereby removes stains and/or soils from the textiles. The compounds are particularly efficient at removing dingy soils from textiles. Dingy soils are those that build up on textiles after much usage and washing, and result in a gray or yellow tint on a white textile. These soils are a blend of particulate and greasy materials.

The compounds of the invention provide effective bleaching over a wide range of temperature (5° C. to 85° C.), a preferred range being from about 30° C. to about 60° C.

The compounds of the invention perform surprisingly well under full soil load conditions. Alkyl substituted aromatic peroxyacids with comparable chain length substitution do not provide effective bleaching in the presence of soil.

In U.S. Pat. No. 4,154,695, McCrudden et al, issued May 15, 1979, and U.S. Pat. No. 4,288,388, McCrudden et al, issued Sept. 8, 1981, both incorporated herein by reference, disclose aromatic peroxyacids for use as bleaching compositions. They specifically disclose aromatic peroxyacids with a further substitution of the benzene ring. Lower alkyl groups are described as a possible substitution, methyl being the only group specifically mentioned.

Surprisingly, the $C_4$–$C_8$ alkoxy substituted aromatic peroxyacids provided highly effective bleaching even in the presence of high soil loads, such as those found in many typical consumer wash loads.

The peroxyacid may be used directly as a bleaching agent. For improved stability, when incorporated into the bleaching and detergent compositions described hereinafter the magnesium salt of the peroxyacid is preferred.

The Magnesium Peroxycarboxylate

The magnesium salt has the following general formula

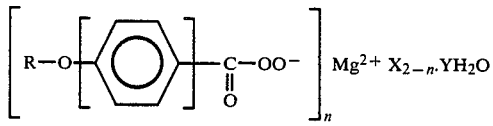

wherein R is an alkyl group containing from about 4 to about 8, preferably from about 5 to about 8 and most preferably about 6 carbon atoms, X is a compatible anion, n is 1 or 2, and Y is an integer from about 0 to about 6, and preferably from about 2 to about 4.

The compounds are solid and possess excellent storage stability, especially under alkaline conditions as when admixed with a detergent composition. Stability means that the solid magnesium peroxycarboxylates retain the active oxygen during storage to a much greater extent than the corresponding peroxyacids. The active oxygen in the magnesium peroxycarboxylate is readily available. This means that the solid magnesium peroxycarboxylates are readily soluble or dispersible and yield solutions containing active oxygen. When the solution is aqueous, it cannot be distinguished from an aqueous solution prepared from the corresponding peroxyacid and an equivalent amount of magnesium, when the solutions are adjusted to the same pH.

In addition to excellent storage stability when admixed with detergent compositions; the magnesium peroxycarboxylates have a higher safety than the corresponding peroxyacids both in handling purposes and to the substrate. Also the solid magnesium peroxycarboxylates have superior odor, dispersibility and handling properties relative to the corresponding peroxyacid.

It is believed that the increased stability of the magnesium salt when used in compositions relative to the primary peroxyacid is due to the fact that the active oxygen atom is nucleophilic rather than electrophilic as it is in the corresponding peroxycarboxylate. Nucleophilic agents which would attack an electrophilic oxygen are much more prevalent in bleaching and detergent compositions than electrophilic agents which would attack a nucleophilic oxygen.

The magnesium peroxycarboxylates can be prepared via the process of U.S. Pat. No. 4,483,781, Hartman, issued Nov. 20, 1984, incorporated herein by reference. Hartman discloses magnesium peroxycarboxylates substituted with alkoxy groups of from $C_1$–$C_5$.

Applicant has found, contrary to the techings of Hartman that $C_{4-8}$ alkoxy substituted aromatic peroxyacids are superior in bleaching performance to the lower alkoxy substituted aromatic peroxyacids.

When placed in use with an actual soil load, the shorter chain alkoxy substituted aromatic peroxyacid does not provide effective bleaching.

The Bleach Activator

The bleach activators within the invention are alkoxy substituted aromatic peroxyacids of the general formula

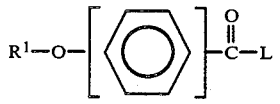

wherein $R^1$ is as defined for the peroxyacid and L is a suitable leaving group. A leaving group is any group that is displaced from the bleach activator as a consequence of the nucleophilic attack on the bleach activator by the perhydroxide anion. This, the perhydrolysis reaction, results in the formation of the peroxycarboxylic acid. Generally, for a group to be a suitable leaving group it must exert an electron attracting effect. It should also form a stable entity so that the rate of the back reaction is negligible. This facilitates the nucleophilic attack by the perhydroxide anion.

The L group must be sufficiently reactive for the reaction to occur within the optimum time frame (e.g., a wash cycle). However, if L is too reactive, this activator will be difficult to stabilize for use in a bleaching or detergent composition.

These characteristics are generally paralleled by the pKa of the conjugate acid of the leaving group, although exceptions to this convention are known. Commonly, leaving groups that exhibit such behavior are those in which their conjugate acid has a pKa in the range of from about 4 to about 13, preferably from about 6 to about 11 and most preferably from about 8 to about 11.

Preferred bleach activators are those of the above general formula wherein $R^1$ is as defined for the peroxy acid and L is selected from the group consisting of:

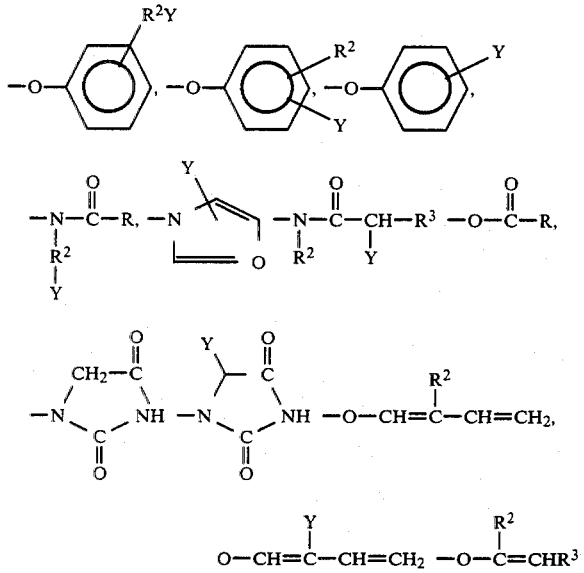

wherein R is

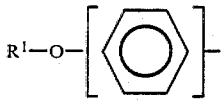

as defined above, $R^2$ is an alkyl chain containing from about 1 to about 8 carbon atoms, $R^3$ is H or $R^2$, and Y is H or a solubilizing group. The preferred solubilizing groups are $-SO_3^-M^+$, $-COO^-M^+$, $-SO_4^-M^+$, $(-N^+R_3^4)X^-$ and $O\leftarrow N(R_2^4)-$ and most preferably $-SO_3^-M^+$ and $-COO^-M^+$ wherein $R^4$ is an alkyl chain containing from about 1 to about 4 carbon atoms, M is a cation which provides solubility to the bleach activator and X is an anion which provides solubility to the bleach activator. Preferably, M is an alkali metal, ammonium or substituted ammonium cation, with sodium and potassium being most preferred, and X is a halide, hydroxide, methylsulfate or acetate anion. It should be noted that bleach activators with a leaving group that does not contain a solubilizing group should be well dispersed in the bleaching solution in order to assist in their dissolution.

Preferred bleach activators are also those of the above general formula wherein L is as defined in the general formula and $R^1$ is an alkyl group containing about 6 carbon atoms.

Particularly preferred bleach activators are those of the above general formula wherein $R^1$ is an alkyl group containing from about 4 to about 8 carbon atoms and L is selected from the group consisting of:

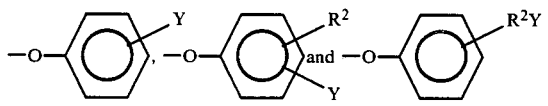

wherein $R^2$ is as defined above and Y is $—SO_3^-M^+$ or $—COO^-M^+$ wherein M is as defined above.

Preferred bleach activators are those of the above general formula wherein $R^1$ is a linear alkyl chain containing from about 5 to about 8, and most preferably about 6 carbon atoms, and L is selected from the group consisting of:

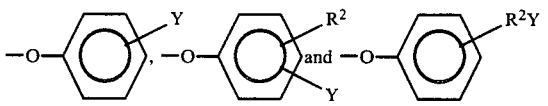

wherein $R^2$ is as defined above and Y is $—SO_3^-M^+$ or $—COO^-M^+$ wherein M is as defined above.

The most preferred bleach activators have the formula:

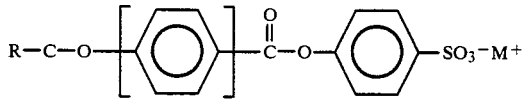

wherein R is a linear alkyl chain containing about 6 carbon atoms and M is sodium or potassium.

When the bleach activator is the source of the peroxyacid, optimum bleaching performance is obtained with bleaching solutions wherein the pH of such solution is between about 8.5 and 10.5 and preferably between 9 and 10. It is preferred that such pH be greater than 9 to optimize the rate of perhydrolysis. Such pH can be obtained with substances commonly known as buffering agents, which are optional components of the bleaching compositions herein.

The Bleaching Compositions

The bleaching compositions of the invention are those which, upon dissolution in aqueous solution, provide a bleaching compound of the formula

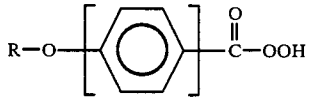

where R is an alkyl group with from about 4 to about 8 carbon atoms, preferably about 5 to about 8 carbon atoms, and most preferably 6 carbon atoms.

Such compositions provide extremely effective and efficient surface bleaching of textiles which thereby remove stains and/or soils from the textiles. The compositions are particularly effective at removing dingy soils from textiles. Dingy soils are soils that build up on textiles after numerous cycles of usage and washing, and thus, result in a white textile having a gray or yellow hint. These soils tend to be blend of particulate and greasy materials. The removal of this type of soil is sometimes referred to as "dingy fabric clean up".

The bleaching compositions provide such bleaching over a wide range of bleach solution temperatures. Such bleaching is obtained in bleach solutions wherein the solution temperature is at least about 5° C. Inorganic peroxygen bleaches would be ineffective and/or impracticable at temperatures below about 60° C.

The invention relates to compositions comrising a peroxyacid of the formula

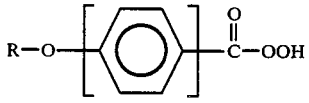

wherein R is an alkyl group with from about 4 to about 8 carbon atoms, preferably from about 5 to about 8 carbon atoms, and most preferably about 6 carbon atoms.

The invention also relates to compositions comprising a magnesium peroxycarboxylate of the formula

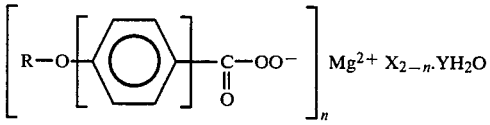

wherein R is an alkyl group containing from about 4 to about 8, preferably from about 5 to about 8, and most preferably about 6 carbon atoms, X is a compatible anion, n is 1 or 2, and Y is an integer from 0 to about 6, and preferably 2 to about 4.

This invention also relates to bleaching compositions containing a peroxygen bleach capable of releasing hydrogen peroxide in an aqueous solution and bleach activators of the formula

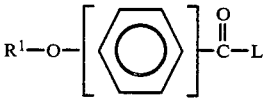

wherein $R^1$ is an alkyl group containing from about 4 to about 8, preferably about 5 to about 8, and most preferably 6 carbon atoms.

The bleaching mechanism generally, and the surface bleaching mechanism in particular, are not completely understood. However, it is generally believed that the bleach activator undergoes nucleophilic attack by a perhydroxide anion, which is generated from the hydrogen peroxide evolved by the peroxygen bleach, to form a peroxycarboxylic acid. This reaction is commonly referred to as perhydrolysis.

A second less desirable reaction involves the formation of the less reactive diacyl peroxide. This reaction increases in consequence with the hydrophobicity of R. While some diacyl peroxide production is desirable in order to improve bleaching of specific stains (e.g., spaghetti sauce or barbecue sauce) because of the lessened reactivity, conditions are preferred which produce only a small percentage of the diacyl peroxide.

It is also believed, that the bleach activators within the invention can render peroxygen bleaches more efficient even at bleach solution temperatures wherein bleach activators are not necessary to activate the bleach, i.e., above about 60° C. Therefore, with bleach compositions of the invention, less peroxygen bleach is required to get the same level of surface bleaching performance as is obtained with the peroxygen bleach alone.

The bleaching compositions wherein the bleach activator is used also have, as an essential component a peroxygen bleach capable of releasing hydrogen peroxide in aqueous solution.

The Peroxygen Bleaching Compound

The peroxygen bleaching compounds useful herein are those capable of yielding hydrogen peroxide in an aqueous solution. These compounds are well known in the art and include hydrogen peroxide and the alkali metal peroxides, organic peroxide bleaching compounds such as urea peroxide, and inorganic persalt bleaching compounds, such as the alkali metal perborates, percarbonates, perphosphates, and the like. Mixtures of two or more such bleaching compounds can also be used, if desired.

Preferred peroxygen bleaching compounds include sodium perborate, commercially available in the form of mono-, tri- and tetra-hydrates, sodium carbonate peroxyhydrate, sodium pyrophosphate peroxyhydrate, urea peroxyhydrate, and sodium peroxide. Particularly preferred are sodium perborate tetrahydrate and, especially, sodium perborate monohydrate. Sodium perborate monohydrate is especially preferred because it is very stable during storage and yet still dissolves very quickly in the bleaching solution. It is believed that such rapid dissolution results in the formation of higher levels of percarboxylic acid and, thus, enhanced surface bleaching performance.

The level of peroxygen bleach within compositions of the invention is from about 0.1% to about 95% and preferably from about 1% to about 60%. When the bleaching compositions within the invention are also detergent compositions it is preferred that the level of peroxygen bleach is from about 1% to about 20%.

The level of bleach activator within the compositions of the invention is from about 0.1% to about 60% and preferably from about 0.5% to about 40%. When the bleaching compositions within the invention are also detergent compositions it is preferable that the level of bleach activator is from about 0.5% to about 20%, more preferably from about 2% to about 8%.

Optional Components

As a preferred embodiment, the bleaching compositions of the invention can be detergent compositions. Thus, the bleaching compositions can contain typical detergent composition components such as detergency surfactants and detergency builders. In such preferred embodiments the bleaching compositions are particularly effective. The bleaching compositions of this invention can contain all of the usual components of detergent compositions including the ingredients set forth in U.S. Pat. No. 3,936,537, Baskerville et al, incorporated herein by reference. Such components include color speckles, suds boosters, suds suppressors, antitarnish and/or anticorrosion agents, soil-suspending agents, soil-release agents, dyes, fillers, optical brighteners, germicides, alkalinity sources, hydrotropes, antioxidants, enzymes, enzyme stabilizing agents, perfumes, etc.

The detergent surfactants can be any one or more surface active agents selected from anionic, nonionic, zwitterionic, amphoteric and cationic classes and compatible mixtures thereof. Detergent surfactants useful herein are listed in U.S. Pat. No. 3,664,961, Norris, issued May 23, 1972, and in U.S. Pat. No. 3,919,678, Laughlin et al, issued Dec. 30, 1975, both incorporated herein by reference. Useful cationic surfactants also include those described in U.S. Pat. No. 4,222,905, Cockrell, issued Sept. 16, 1980, and in U.S. Pat. No. 4,239,659, Murphy, issued Dec. 16, 1980, both incorporated herein by reference. The following are representative examples of detergent surfactants useful in the present compositions.

Water-soluble salts of the higher fatty acids, i.e., "soaps", are useful anionic surfactants in the compositions herein. This includes alkali metal soaps such as the sodium, potassium, ammonium, and alkanolammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Useful anionic surfactants also include the water-soluble salts, preferably the alkali metal, ammonium and alkylolammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.) Examples of this group of synthetic surfactants are the sodium and potassium alkyl sulfates, especially those obtained by sulfating the higher alcohols ($C_8$–$C_{18}$ carbon atoms) such as those produced by reducing the glycerides of tallow or coconut oil; and the sodium and potassium alkylbenzene sulfonates in which the alkyl group contains from about 9 to about 15 carbon atoms, in straight chain or branched chain configuration, e.g., those of the type described in U.S. Pat. Nos. 2,220,099 and 2,477,383. Especially valuable are linear straight chain alkylbenzene sulfonates in which the average number of carbon atoms in the alkyl group is from about 11 to 13, abbreviated as $C_{11-13}$LAS.

Other anionic surfactants herein are the sodium alkyl glyceryl ether sulfonates, especially those ethers of higher alcohols derived from tallow and coconut oil; sodium coconut oil fatty acid monoglyceride sulfonates and sulfates; sodium or potassium salts of alkyl phenol ethylene oxide ether sulfates containing from about 1 to about 10 units of ethylene oxide per molecule and wherein the alkyl groups contain from about 8 to about 12 carbon atoms; and sodium or potassium salts of alkyl ethylene oxide ether sulfates containing about 1 to about 10 units of ethylene oxide per molecule and wherein the alkyl group contains from about 10 to about 20 carbon atoms.

Other useful anionic surfactants herein include the water-soluble salts of esters of alpha-sulfonated fatty acids containing from about 6 to 20 carbon atoms in the fatty acid group and from about 1 to 10 carbon atoms in the ester group; water-soluble salts of 2-acyloxyalkane- 1-sulfonic acids containing from about 2 to 9 carbon atoms in the acyl group and from about 9 to about 23 carbon atoms in the alkane moiety; water-soluble salts of olefin and paraffin sulfonates containing from about 12 to 20 carbon atoms; and beta-alkyloxy alkane sulfonates containing from about 1 to 3 carbon atoms in the alkyl group and from about 8 to 20 carbon atoms in the alkane moiety.

Water-soluble nonionic surfactants are also useful in the compositions of the invention. Such nonionic materials include compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements.

Suitable nonionic surfactants include the polyethylene oxide condensates of alkyl phenols, e.g., the condensation products of alkyl phenols having an alkyl group containing from about 6 to 15 carbon atoms, in either a straight chain or branched chain configuration, with from about 3 to 12 moles of ethylene oxide per mole of alkyl phenol.

Preferred nonionics are the water-soluble and water-dispersible condensation products of aliphatic alcohols containing from 8 to 22 carbon atoms, in either straight chain or branched configuration, with from 3 to 12 moles of ethylene oxide per mole of alcohol. Particularly preferred are the condensation products of alcohols having an alkyl group containing from about 9 to 15 carbon atoms with from about 4 to 8 moles of ethylene oxide per mole of alcohol.

Semi-polar nonionic surfactants include water-soluble amine oxides containing one alkyl moiety of from about 10 to 18 carbon atoms and two moieties selected from the group of alkyl and hydroxyalkyl moieties of from about 1 to about 3 carbon atoms; water-soluble phosphine oxides containing one alkyl moiety of about 10 to 18 carbon atoms and two moieties selected from the group consisting of alkyl groups and hydroxyalkyl groups containing from about 1 to 3 carbon atoms; and water-soluble sulfoxides containing one alkyl moiety of from about 10 to 18 carbon atoms and a moiety selected from the group consisting of alkyl and hydroxyalkyl moieties of from about 1 to 3 carbon atoms.

Ampholytic surfactants include derivatives of aliphatic or aliphatic derivatives of heterocyclic secondary and tertiary amines in which the aliphatic moiety can be straight chain or branched and wherein one of the aliphatic substituents contains from about 8 to 18 carbon atoms and at least one aliphatic substituent contains an anionic water-solubilizing group.

Zwitterionic surfactants include derivatives of aliphatic, quaternary, ammonium, phosphonium, and sulfonium compounds in which one of the aliphatic substituents contains from about 8 to 18 carbon atoms.

The level of detergent surfactant that can be employed is from 0% to about 50%, preferably from about 1% to about 30% and most preferably from about 10% to about 25% by weight of the total composition.

In addition to detergent surfactants, detergency builders can be employed in the bleaching compositions. Water-soluble inorganic or organic electrolytes are suitable builders. The builder can also be water-insoluble calcium ion exchange materials; nonlimiting examples of suitable water-soluble, inorganic detergent builders include: alkali metal carbonates, borates, phosphates, bicarbonates and silicates. Specific examples of such salts include sodium and potassium tetraborates, bicarbonates, carbonates, orthophosphates, pyrophosphates, tripolyphosphates, and metaphosphates.

Examples of suitable organic alkaline detergency builders include: (1) water-soluble amino carboxylates and aminopolyacetates, for example, nitrilotriacetates, glycinates, ethylenediamine tetraacetates, N-(2-hydroxyethyl)nitrilo dicaetates and diethylenetriamine pentaacetates; (2) water-soluble salts of phytic acid, for example, sodium and potassium phytates; (3) water-soluble polyphosphonates, including sodium, potassium, and lithium salts of ethane-1-hydroxy-1, 1-diphosphonic acid; sodium, potassium, and lithium salts of ethylene diphosphonic acid; and the like; (4) water-soluble polycarboxylates such as the salts of lactic acid, succinic acid, malonic acid, maleic acid, citric acid, carboxymethyloxysuccinic acid, 2-oxo-1,1,3-propane tricarboxylic acid, 1,1,2,2-ethane tetracarboxylic acid, mellitic acid and pyromellitic acid; and (5) water-soluble polyacetals as disclosed in U.S. Pat. Nos. 4,144,266 and 4,246,495 incorporated herein by reference.

Another type of detergency builder material useful in the present compositions comprises a water-soluble material capable of forming a water-insoluble reaction product with water hardness cations preferably in combination with a crystallization seed which is capable of providing growth sites for said reaction product. Such "seeded builder" compositions are fully disclosed in British Patent Specification No. 1,424,406.

A further class of detergency builder materials useful in the present invention are insoluble sodium aluminosilicates, particularly those described in Belgian Pat. No. 814,874, issued Nov. 12, 1974, incorporated herein by reference. This patent discloses and claims detergent compositions containing sodium aluminosilicates having the formula:

$$Na_z(AlO_2)_z(SiO_2)_yXH_2O$$

wherein z and y are integers equal to at least 6, the molar ratio of z to y is in the range of from 1.0:1 to about 0.5:1, and X is an integer from about 15 to about 264, said aluminosilicates having a calcium ion exchange capacity of at least 200 milligrams equivalent/gram and a calcium ion exchange rate of at least about 2 grains/gallon/minute/gram. A preferred material is Zeolite A which is:

$$Na_{12}(SiO_2AlO_2)_{12}27H_2O$$

The level of detergency builder of the bleaching compositions is from 0% to about 70%, preferably from about 10% to about 60% and most preferably from about 20% to about 60%.

Buffering agents can be utilized to maintain the desired alkaline pH of the bleaching solutions. Buffering agents include, but are not limited to many of the detergency builder compounds disclosed hereinbefore. Buffering agents suitable for use herein are those well known in the detergency art.

Preferred optional ingredients include suds modifiers particularly those of suds suppressing types, exemplified by silicones, and silica-silicone mixtures.

U.S. Pat. Nos. 3,933,672, issued Jan. 20, 1976 to Bartolotta et al, and 4,136,045, issued Jan. 23, 1979 to Gault et al, incorporated herein by reference, disclose silicone suds controlling agents. The silicone material can be represented by alkylated polysiloxane materials such as silica aerogels and xerogels and hydrophobic silicas of various types. The silicone material can be described as siloxane having the formula:

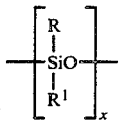

wherein x is from about 20 to about 2,000 and R and $R^1$ are each alkyl or aryl groups, especially methyl, ethyl, propyl, butyl and phenyl. The polydimethylsiloxanes (R and $R^1$ are methyl) having a molecular weight within the range of from about 200 to about 2,000,000, and higher, are all useful as suds controlling agents. Additional suitable silicone materials wherein the side chain groups R and $R^1$ are alkyl, aryl, or mixed alkyl or aryl hydrocarbyl groups exhibit useful suds controlling properties. Examples of the like ingredients include diethyl-, dipropyl-, dibutyl-, methyl-, ethyl-, phenylmethylpoly-siloxanes and the like. Additional useful silicone suds controlling agents can be represented by a mixture of an alkylated siloxane, as referred to hereinbefore, and solid silica. Such mixtures are prepared by affixing the silicone to the surface of the solid silica. A preferred silicone suds controlling agent is represented by a hydrophobic silanated (most preferably trimethylsilanated) silica having a particle size in the range from about 10 millimicrons to 20 millimicrons and a specific surface area above about 50 $m^2$/gm. intimately admixed with dimethyl silicone fluid having a molecular weight in the range from about 500 to about 200,000 at a weight ratio of silicone to silanated silica of from about 19:1 to about 1:2. The silicone suds suppressing agent is advantageously releasably incorporated in a water-soluble or water-dispersible, substantially non-surface-active detergent-impermeable carrier.

Particularly useful suds suppressors are the self-emulsifying silicone suds suppressors, described in U.S. Pat. No. 4,073,118, Gault et al, issued Feb. 21, 1978, incorporated herein by reference. An example of such a compound is DB-544, commercially available from Dow Corning, which is a siloxane/glycol copolymer.

Suds modifiers as described above are used at levels of up to approximately 2%, preferably from about 0.1 to about 1½% by weight of the surfactant.

Microcrystalline waxes having a melting point in the range from 35° C.–115° C. and a saponification value of less than 100 represent additional examples of preferred suds control components for use in the subject compositions, and are described in detail in U.S. Pat. No. 4,056,481, Tate, issued Nov. 1, 1977, incorporated herein by reference. The microcrystalline waxes are substantially water-insoluble, but are water-dispersible in the presence of organic surfactants. Preferred microcrystalline waxes have a melting point from about 65° C. to 100° C., a molecular weight in the range from 400–1,000; and a penetration value of at least 6, measured at 77° F. by ASTM-D1321. Suitable examples of the above waxes include: microcrystalline and oxidized microcrystalline petroleum waxes; Fischer-Tropsch and oxidized Fischer-Tropsch waxes; ozokerite; ceresin; montan wax; beeswax; candelilla; and carnauba wax.

Alkyl phosphate esters represent an additional preferred suds control agent for use herein. These preferred phosphate esters are predominantly monostearyl phosphate which, in addition thereto, can contain di- and tristearyl phosphates and monooleyl phosphate, which can contain di- and trioleyl phosphate.

Other suds control agents useful in the practice of the invention are the soap or the soap and nonionic mixtures as disclosed in U.S. Pat. Nos. 2,954,347 and 2,954,348, incorporated herein by reference.

This invention also relates to the process of bleaching textiles with a peroxyacid of the following formula

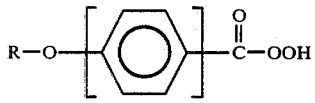

The pure peroxyacid should provide from about 5 ppm available oxygen in solution to about 25 ppm.

The following examples are given to illustrate the parameters of and compositions within the invention. All percentages, parts and ratios are by weight unless otherwise indicated.

EXAMPLE I

Preparation of sodium 4-hexyloxybenzoyloxybenzenesulfonate.

The anhydrous disodium salt of p-phenolsulfonic acid was prepared as follows. To a slurry of sodium p-phenolsulfonic acid dihydrate (250 g, 1.08 mol) in 200 mL distilled water was added 43.0 g (1.08 mol) of sodium hydroxide as a 50.5% solution. The resulting slurry was evaporated on a rotary evaporator to yield a hard, white solid. This solid was dried to constant weight in a convection oven at 150° C. to yield 229 g (97%) of the anhydrous disodium salt. To a suspension of 45.2 g (0.207 mol) of the above anhydrous disodium salt of p-phenolsulfonic acid, in 250 mL ethylene glycol dimethyl ether was added in one portion a solution of 50.0 g (0.207 mol) of 4-hexyloxybenzoyl chloride in 50 mL ethylene glycol dimethyl ether. The resulting stirred suspension was refluxed under nitrogen for 3 hours, cooled, filtered, and the collected solid washed with diethyl ether. The resulting solid was stirred with 200 mL water, filtered, and washed with water. The solid was then stirred with 150 mL methanol, filtered, and washed with methanol. Vacuum drying afforded 64.2 g (78%) of sodium 4-hexyloxybenzoyloxybenzenesulfonate as an off-white solid.

EXAMPLE II

Preparation of sodium 4-butoxybenzoyloxybenzenesulfonate.

The general procedure described in Example I was followed. Anhydrous p-phenolsulfonic acid, disodium salt (51.2 g., 0.235 mol), 4-butoxybenzoyl chloride (50.0 g, 0.235 mol), and 250 mL ethylene glycol dimethyl ether were refluxed under nitrogen for 4 hours. The resulting mixture was cooled in an ice bath, filtered, and the collected solid washed with diethyl ether. The crude solid (85.6 g) was stirred with 150 mL ice-cold water, filtered, and washed with ice-cold water. While still on the filter the solid was washed with three 25 mL portions of ice-cold methanol. Yield (after vacuum drying) was 56.0 g of white solid. The NMR spectrum (dimethyl-$d_6$ sulfoxide solvent) showed that the solid consisted of 95% sodium 4-butoxybenzoyloxybenzenesulfonate and 5% sodium p-phenolsulfonate. The yield of purified sodium 4-butoxybenzoyloxybenzenesulfonate was 61%.

EXAMPLE III

Preparation of blend of sodium 4-hexyloxybenzoyloxybenzenesulfonate with sodium sulfate and sodium linear alkylbenzene sulfonate (LAS).

A weight of 11.8 g of 85% active $C_{11.6}$ LAS was dissolved in 50 mL water and the pH adjusted to 7.0 with 0.1N sulfuric acid. This solution was blended with 40.0 g of sodium 4-hexyloxybenzoyloxybenzenesulfonate (powdered and passed through 24 mesh) and 100.0 g of powdered sodium sulfate. The resulting paste was then dried under vacuum, powdered, and passed through 24 mesh to yield a rapidly soluble composition containing 26.4% sodium 4-hexyloxybenzoyloxybenzenesulfonate.

EXAMPLE IV

Perhydrolysis of sodium 4-hexyloxybenzoyloxybenzenesulfonate to form 4-hexyloxyperoxybenzoic acid.

A detergent granule having the following composition was prepared:

| | % |
|---|---|
| Sodium $C_{13}$ linear alkylbenzene sulfonate | 8.5 |
| Sodium $C_{14-15}$ alkyl sulfate | 8.5 |
| $C_{12-13}$ alkyl polyethoxylate$_{6.5}$ | 2.3 |
| $C_{12}$ alkyl trimethylammonium chloride | 1.1 |
| Sodium tripolyphosphate | 36.4 |
| Sodium carbonate | 13.6 |
| Sodium silicate | 5.7 |
| Sodium sulfate | 11.7 |
| Moisture | 8.5 |
| Minor ingredients | 3.6 |

A 4 liter flask was equipped with a magnetic stirrer and charged with 4 L of 95° F. city water, 5.00 g of the above detergent granules, 0.21 g of sodium perborate monohydrate, and 0.89 g of the composition described in Example III. The resulting solution was stirred, aliquots withdrawn at various time intervals, and the aliquots analyzed for organic peroxyacid by a conventional iodometric method. This method consisted of pouring the solution aliquot onto ice, acidification of the resulting mixture with acetic acid, addition of potassium iodide solution, and titration of the liberated iodine with sodium thiosulfate solution. The volume of sodium thiosulfate solution required was then used to calculate the concentration in solution of available oxygen (AvO) due to the formation of organic peroxyacid. The concentration of AvO was then used to calculate the concentration of 4-hexyloxyperoxybenzoic acid.

Tabulated below are the results obtained for the above experiment.

| | | 4-hexyloxyperoxybenzoic acid | |
|---|---|---|---|
| Time (min.) | [Peroxyacid AvO] (ppm) | Concentration in ppm | % of theoretical yield |
| 2 | 0.56 | 8.35 | 23 |
| 7 | 1.17 | 17.4 | 49 |
| 12 | 1.37 | 20.4 | 57 |
| 20 | 1.60 | 23.8 | 67 |

EXAMPLE V

Preparation of 4-hexyloxyperoxybenzoic acid.

4-Hexyloxybenzoyl chloride

Thionyl chloride (485 g of 98%, 4.00 mol) was added dropwise to 300 g (1.35 mol) of 4-hexyloxybenzoic acid. The resulting mixture was refluxed under nitrogen for 2 hours. Distillation yielded 318 g (98%) of 4-hexyloxybenzoyl chloride [boiling point 149°-153° C. (7.5 mm)].

4-Hexyloxyperoxybenzoic acid

Sodium hydroxide (16.6 g of 50%, 0.208 mol), hydrogen peroxide (7.9 g of 98%, 0.208 mol), magnesium sulfate (0.20 g, 1.66 mmol), water (65 mL), and dioxane (225 mL) were combined in a one liter beaker equipped with a magnetic stirrer. To the resulting stirred solution was added 4-hexyloxybenzoyl chloride (10.0 g, 0.0415 mol) dropwise over a 5 minute period. The resulting mixture was stirred for 1¼ hours, poured into 150 mL 20% sulfuric acid, and the peroxyacid extracted into 200 mL methylene chloride. The methylene chloride solution was washed with water and dried over sodium sulfate; analysis (see Example IV) of the dry solution indicated a yield of peroxyacid of 60%.

The methylene chloride solution was evaporated to dryness on a rotary evaporator to 9.6 g of a white solid. This solid was stirred with 50 mL of warm heptane and the resulting suspension filtered to yield 6.7 g of 4-hexyloxyperoxybenzoic acid (AvO 5.46%, theoretical AvO 6.71%). This material was further purified by recrystallization from heptane to give a first crop of 1.9 g of colorless needles which was discarded and a second crop of 3.6 g of colorless needles having an AvO (as peroxyacid) 6.03% and melting point 47°-52° C. Analysis of this second crop for both peroxyacid AvO and diacylperoxide AvO (see *Organic Peroxides* (Ed. D. Swern), Vol. I, Wily-Interscience, New York, 1970, p. 501) indicated that this material was a 90/10 mixture of 4-hexyloxyperoxybenzoic acid and 4,4'-dihexyloxybenzoylperoxide.

EXAMPLE VI

Preparation of the magnesium salt of 4-hexyloxyperoxybenzoic acid.

A dispersion of magnesium hydroxide (4.20 mmol) was prepared by dissolving magnesium sulfate (0.505 g, 4.20 mmol) 20 ml water and adding 8.4 mmol of 1N sodium hydroxide (0.336 g, 8.40 mmol). To this stirred dispersion was added in one portion a solution of 4-hexyloxyperoxybenzoic acid (2.00 g, 8.40 mmol) in 30 mL ethyl acetate. The resulting mixture was stirred for 15 minutes and the precipitated solid collected by filtration and washed with water and then ethyl acetate. Air drying afforded 1.9 g of magnesium bis(4-hexyloxyperoxybenzoate), AvO (see Example IV) 4.58%, melting point decomposes at from 90°-210° C., liquifies at from 210°-220° C.

EXAMPLE VII

Bleaching performance of 4-hexyloxyperoxybenzoic acid.

In this Example 4-hexyloxyperoxybenzoic acid was formed during the washing cycle by the reaction of sodium 4-hexyloxybenzoyloxybenzene sulfonate with hydrogen peroxide (from sodium perborate monohydrate) in the presence of the detergent granules described in Example IV. Bleaching performance was determined by comparing the fabric whitening and stain removal of this treatment with a treatment containing only the detergent granule. Thus, to each of two top-loading automatic washing machines was added 5 lbs. of naturally soiled ballast fabrics and 68 liters of 95° F. city water having a hardness of 6 gr/gal. To one machine was added 89 g of the detergent granules described in Example IV, and to a second machine was added 89 g of this same detergent granule, 6.1 g of sodium perborate monohydrate, and 27.0 g of a composition like that described in Example III and containing 22.7% of sodium 4-hexyloxybenzoyloxybenzene sulfonate. The wash solution in this second machine thus contained concentrations of 90 ppm of both sodium perborate monohydrate and sodium 4-hexyloxybenzoyloxybenzene sulfonate.

To each of the above wash solutions were added two sets of naturally soiled white fabrics and two sets of artificially stained swatches. The washing machines were then allowed to complete their normal washing and rinsing cycles, and the ballast and test fabrics were dryer dried. This procedure was repeated three times, using different sets of ballast fabrics, naturally soiled white fabrics and artificially stained swatches for each replicate.

After completion of the three replicates, the fabrics and swatches were arranged under suitable lighting for comparison of soil and stain removal. Three expert graders compared the extent of removal of the soils and stains using the following scale:

0—no difference between two swatches
1—thought to be a difference
2—certain of a difference
3—certain of a large difference
4—certain of a very large difference In this grading the naturally soiled white fabrics were compared for improvement in whiteness, and the artificially stained swatches were compared for removal of the stain. The grades obtained were then averaged and normalized to yield the results shown below. Also tabulated below are the percentage of grades for each fabric or swatch type where the treatment containing sodium 4-hexyloxybenzoyloxybenzene sulfonate and sodium perborate monohydrate was superior to the detergent alone treatment by a score of 2 or more on the above scale.

| | Treatment and Average Relative Grade | | % of Grades ≧ 2 |
|---|---|---|---|
| | Detergent Granule Alone | Detergent granule + sodium 4-hexyloxybenzoyloxybenzene sulfonate + sodium perborate monohydrate | Detergent granule + sodium 4-hexyloxybenzoyloxybenzene sulfonate + sodium perborate monohydrate versus detergent granule alone |
| Naturally Soiled Fabrics | | | |
| T-shirts | 0 | 2.0 | 89 |
| Dish towels | 0 | 1.6 | 56 |
| Pillowcases | 0 | 1.3 | 39 |
| Artificially Stained Fabrics | | | |
| Clay | 0 | 0.9 | 50 |
| Spaghetti sauce | 0 | 2.0 | 83 |
| Barbecue sauce | 0 | 0.2 | 44 |
| Tea | 0 | 1.7 | 65 |
| Grass | 0 | 1.8 | 72 |
| Animal blood | 0 | −0.1 | 17 |
| Blueberries | 0 | 1.2 | 44 |

EXAMPLE VIII

Performance of 4-but-, 4-pentyl-, and 4-hexyloxyperoxybenzoic acids in the presence of both clean and soiled ballast loads.

4-but-, 4-pentyl-, and 4-hexyl-oxyperoxy-benzoic acids were formed by the reactions of the corresponding sodium alkyloxybenzoyloxybenzene sulfonates with hydrogen peroxide from sodium perborate monohydrate in the presence of the detergent granule described in Example IV. Measurements of bleaching performance were conducted with 7.6 liter solutions in 95° F. water containing 5 gr/gal hardness as 3:1 molar $Ca^{+2}$:$Mg^{+2}$. The performance of solutions containing 1250 ppm of the detergent granule, 90 ppm of sodium perborate monohydrate, and 90 ppm of a sodium 4-alkyloxybenzoyloxybenzene sulfonate were compared with a solution containing 1250 ppm of the detergent granule alone. These comparisons were made also where the ballast load in each solution was 200 g of clean terrycloth and also where the ballast load consisted of 100 g of naturally soiled T-shirt material plus 100 g of naturally soiled pillowcases. The soiled fabrics and stained swatches were the same as employed in Example VII. The washed fabrics and swatches were graded in a round robin fashion and the relative performance of the various treatments was calculated by standard methods. The results obtained are tabulated below. These results demonstrate that the bleaching performance of the 4-alkyloxyperoxybenzoic acids is relatively unaffected by the presence of soil.

Test 1
Bleaching Performance With a Clean, Terrycloth Ballast

| | Concentration (ppm) | | | |
|---|---|---|---|---|
| Detergent granule | 1250 | 1250 | 1250 | 1250 |
| Sodium perborate monohydrate | | 90 | 90 | 90 |
| Sodium 4-butoxybenzoyloxybenzene sulfonate | | 90 | | |
| Sodium 4-pentyloxybenzoyloxybenzene sulfonate | | | 90 | |
| Sodium 4-hexyloxybenzoyloxy | | | | 90 |
| | Relative Grades | | | |
| Naturally Soiled Fabrics | | | | |
| T-shirts | 0 | 2.0 | 2.4 | 2.1 |
| Dish towels | 0 | 1.5 | 0.9 | 1.1 |
| Pillowcases | 0 | 1.2 | 1.6 | 1.6 |
| Artificially Stained Swatches | | | | |
| Clay | 0 | −0.2 | 0.1 | 0.3 |
| Spaghetti sauce | 0 | 2.3 | 2.1 | 1.6 |
| Barbecue sauce | 0 | 1.9 | 1.3 | 1.3 |
| Tea | 0 | 2.4 | 2.1 | 1.9 |
| Grass | 0 | 1.4 | 2.1 | 2.8 |
| Animal blood | 0 | 0.0 | 0.9 | 1.0 |
| Blueberries | 0 | 2.3 | 1.5 | 1.3 |

| Test 2 Bleaching Performance With a Soiled Ballast of T-Shirts and Pillowcases | | | | |
|---|---|---|---|---|
| | Concentration (ppm) | | | |
| Detergent granule | 1250 | 1250 | 1250 | 1250 |
| Sodium perborate monohydrate | | 90 | 90 | 90 |
| Sodium 4-butoxybenzoyloxy-benzene sulfonate | | 90 | | |
| Sodium 4-pentyloxybenzoyloxy-benzene sulfonate | | | 90 | |
| Sodium 4-hexyloxybenzoyloxy | | | | 90 |
| | Relative Grades | | | |
| Naturally Soiled Fabrics | | | | |
| T-shirts | 0 | 2.1 | 1.4 | 2.3 |
| Dish towels | 0 | 2.0 | 1.9 | 1.9 |
| Pillowcases | 0 | 1.8 | 1.6 | 1.3 |
| Artificially Stained Swatches | | | | |
| Clay | 0 | −0.5 | −0.4 | −0.1 |
| Spaghetti sauce | 0 | 2.7 | 2.2 | 1.4 |
| Barbecue sauce | 0 | 2.2 | 1.9 | 1.6 |
| Tea | 0 | 2.4 | 1.8 | 2.1 |
| Grass | 0 | 1.3 | 2.3 | 2.2 |
| Animal blood | 0 | 1.3 | 1.4 | 1.4 |
| Blueberries | 0 | 2.2 | 1.9 | 1.4 |

EXAMPLE IX

Bleaching Performance of 4-Hexyloxyperoxybenzoic Acid

The data contained in this Example were obtained using the procedures described in Example VII. The treatment containing 4-hexyloxyperoxybenzoic acid consisted of 89 g of the detergent granule described in Example IV, 3.6 g of sodium perborate monohydrate, 15.3 g of a composition like that of Example III and containing 26.7% of sodium 4-hexyloxybenzoyoxybenzene sulfonate, and 0.6 g of an enzyme composition containing protease and having an activity of 2.2 Anson units/g. The resulting wash solution thus contained 52.5 ppm of sodium perborate monohydrate and 60 ppm of sodium 4-hexyloxybenzoyloxybenzene sulfonate. The bleaching performance of this treatment was compared with a treatment that contained 89 g of the base granule alone. The results obtained are tabulated below.

The odors of both the wash solutions and the wet fabrics from the treatments that contained 4-hexyloxyperoxybenzoic acid were evaluated by an expert perfumer; this evalution indicated a complete absence of the malodors that are frequently associated with the use of peroxyacid bleaches.

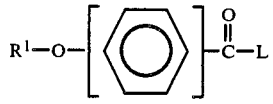

wherein $R^1$ is an alkyl group containing from about 4 to abut 8 carbon atoms, and L is a leaving group the conjugate acid of which has a $pK_a$ in the range of from about 4 to about 13.

2. A compound according to claim 1 wherein $R^1$ is an alkyl group containing from about 5 to about 8 carbon atoms.

3. A compound according to claim 1 wherein $R^1$ is an alkyl group containing about 6 carbons atoms.

4. The compound of claim 1 wherein L is a leaving group, the conjugate acid of which has a $pK_a$ in the range of from about 8 to about 11.

5. The compound of claim 1 wherein L is selected from the group consisting of:

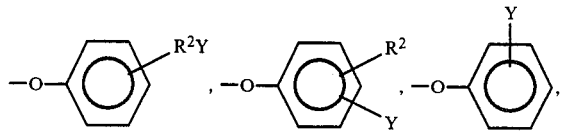

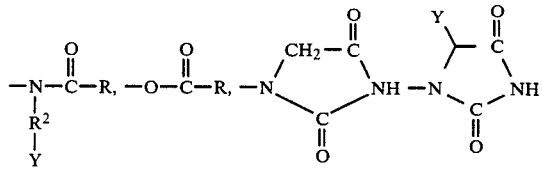

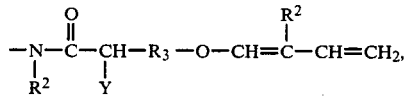

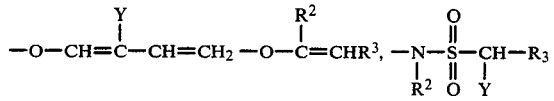

wherein R is

| | Treatment and Average Relative Grade | | % of Grades ≧ 2 |
|---|---|---|---|
| | Detergent Granule Alone | Detergent granule + sodium 4-hexyloxybenzoyloxybenzene sulfonate + sodium perborate monohydrate + enzymes | Detergent granule + sodium 4-hexyloxybenzoyloxybenzene sulfonate + sodium perborate monohydrate + enzymes versus detergent granule alone |
| Naturally Soiled Fabrics | | | |
| T-shirts | 0 | 1.6 | 67 |
| Dish towels | 0 | 1.3 | 44 |
| Pillowcases | 0 | 1.4 | 44 |
| Artificially Stained Fabrics | | | |
| Clay | 0 | 1.2 | 67 |
| Spaghetti sauce | 0 | 1.9 | 78 |
| Barbecue sauce | 0 | 1.3 | 61 |
| Tea | 0 | 2.2 | 89 |
| Grass | 0 | 3.2 | 100 |
| Animal blood | 0 | 0.2 | 28 |
| Blueberries | 0 | 2.2 | 100 |

What is claimed is:

1. A bleach activator of the general formula

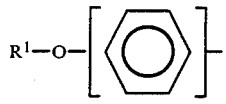

$R^2$ is an alkyl chain containing from about 1 to about 8 carbon atoms, $R^3$ is H or $R^2$, and Y is H or a solubilizing group.

6. The compound of claim 5 wherein Y is selected from the group consisting of: $—SO_3^-M^+$, $—COO^-M^+$, $—SO_4^-M^+$, $(—N^+R_3^4)X^-$ and $O←NR_2^4—$ and mixtures thereof wherein $R^4$ is an alkyl chain containing from about 1 to about 4 carbon atoms, M is a cation which provides solubility to the bleach activator and X is an anion which provides solubility to the bleach activator.

7. The compound of claim 6 wherein Y is selected from the group consisting of $—SO_3^-M^+$, $—COO^-M^+$ and mixtures thereof wherein M is selected from the group consisting of sodium, potassium and mixtures thereof.

8. The compound of claim 5 wherein L is selected from the group consisting of:

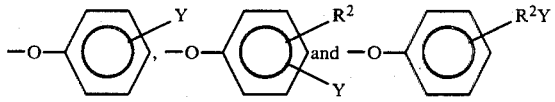

wherein $R^2$ is an alkyl chain containing from about 1 to about 8 carbon atoms, Y is $—SO_3^-M^+$ or $—COO^-M^+$ wherein M is sodium or potassium.

9. The compound of claim 8 wherein L has the general formula:

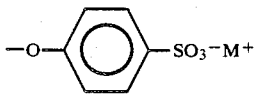

wherein M is sodium or potassium.

10. A composition comprising:

(a) a peroxygen bleaching compound capable of yielding hydrogen peroxide in an aqueous solution; and (b) a bleach activator having the general formula:

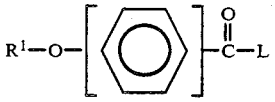

wherein $R^1$ is an alkyl group containing from about 4 to about 8 carbon atoms and L is a leaving group, the conjugate acid of which has a $pK_a$ in the range of from about 4 to about 13; and wherein the molar ratio of hydrogen peroxide yielded by (a) to bleach activator (b) at least about 1.

11. The composition of claim 10 wherein the peroxygen bleaching compound is selected from the group consisting of sodium perborate monohydrate, sodium perborate, tetrahydrate, sodium carbonate peroxyhydrate, sodium pyrophosphate peroxyhydrate, urea peroxyhydrate, sodium peroxide and mixtures thereof.

12. The composition of claim 11 wherein the peroxygen bleaching compound is selected from the group consisting of sodium perborate monohydrate, sodium perborate tetrahydrate and mixtures thereof.

13. The composition of claim 10 wherein L is a leaving group, the conjugate acid of which has a $pK_a$ in the range of from about 7 to about 11.

14. The composition of claim 13 wherein L is a leaving group, the conjugate acid of which has a $pK_a$ in the range of from about 8 to about 11.

15. The composition of claim 10 wherein L is selected from the group consisting of:

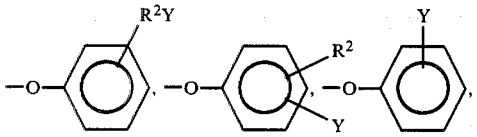

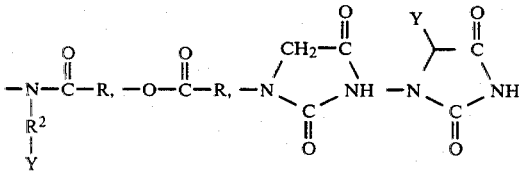

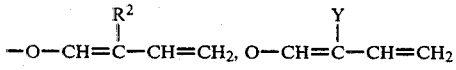

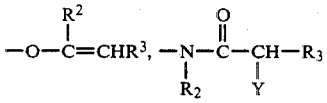

wherein R is

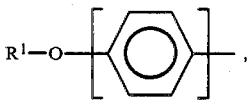

$R^2$ is an alkyl chain containing from about 1 to about 8 carbon atoms, $R^3$ is H or $R^2$, and Y is H or a solubilizing group.

16. The composition of claim 15 wherein Y is selected from the group consisting of: $—SO_3^-M^+$, $—COO^-M^+$, $—SO_4^-M^+$, $(—N^+R_3^4)X^-$ and $O←NR_2^4$ and mixtures thereof wherein $R^4$ is an alkyl chain containing from about 1 to about 4 carbon atoms, M is a cation which provides solubility to the bleach activator and X is an anion which provides solubility to the bleach activator.

17. The composition of claim 16 wherein Y is selected from the group consisting of $—SO_3^-M^+$, $—COO^-M^+$ and mixtures thereof wherein M is selected from the group consisting of sodium, potassium and mixtures thereof.

18. The composition of claim 15 wherein L is selected from the group consisting of:

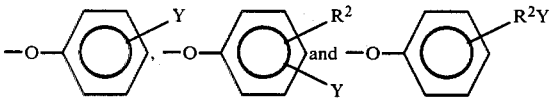

wherein $R^2$ is an alkyl chain containing from about 1 to about 8 carbon atoms, Y is $—SO_3^-M^+$ or $—COO^-M^+$ wherein M is sodium or potassium.

19. The composition of claim 18 wherein L has the general formula:

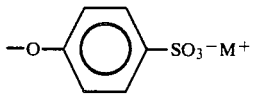

wherein M is sodium or potassium.

20. The composition of claim 19 wherein $R^1$ is a linear alkyl chain containing about 6 carbon atoms.

21. A detergent composition comprising, by weight:

(a) from about 1% to about 60% of a peroxygen bleaching compound capable of yielding hydrogen peroxide in an aqueous solution;

(b) from about 0.5% to about 40% of a bleach activator having the general formula:

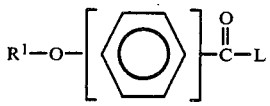

wherein $R^1$ is an alkyl group containing from about 4 to about 8 carbon atoms and L is a leaving group, the conjugate acid of which has a $pK_a$ in the range of from about 4 to about 13; wherein the molar ratio of hydrogen peroxide yielded by (a) to bleach activator (b) is greater than about 1.0; and (c) from about 1% to about 30% of a detergent surfactant.

22. The composition of claim 21 wherein $R^1$ is an alkyl group containing about 6 carbon atoms and L is

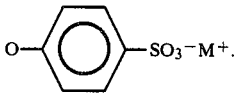

23. The composition of claim 22 which additionally comprises from about 10% to about 60% of a detergency builder.

24. The process of bleaching textiles with a peroxyacid in solution to provide from about 0.5 ppm to about 25 ppm available oxygen.

* * * * *